US009849392B1

(12) United States Patent
Scott

(10) Patent No.: US 9,849,392 B1
(45) Date of Patent: Dec. 26, 2017

(54) VELOCITY SPORT BOOT SYSTEMS

(71) Applicant: Kristine A. Scott, Spruce Grove (CA)

(72) Inventor: Kristine A. Scott, Spruce Grove (CA)

( * ) Notice: Subject to any disclaimer, the term of this patent is extended or adjusted under 35 U.S.C. 154(b) by 0 days.

(21) Appl. No.: 15/153,948

(22) Filed: May 13, 2016

(51) Int. Cl.

| | |
|---|---|
| ***A63B 9/00*** | (2006.01) |
| ***A63C 17/22*** | (2006.01) |
| ***A63G 31/16*** | (2006.01) |
| ***A43B 5/04*** | (2006.01) |
| ***A63C 10/02*** | (2012.01) |

(52) U.S. Cl.
CPC ..... *A63G 31/16* (2013.01); *A43B 5/04* (2013.01); *A43B 5/0401* (2013.01); *A43B 5/0417* (2013.01); *A63C 10/02* (2013.01); *A63C 17/22* (2013.01)

(58) Field of Classification Search
CPC ..... A63B 69/00; A63B 69/18; A63B 22/00; A63B 22/0012; A63B 22/0023; A63C 17/00; A63C 17/0046; A63C 17/02; A63C 17/04; A63C 19/00; A63C 19/10
USPC ..... 472/88–91; 280/11.19, 11.226, 11.227; 434/253; 482/51
See application file for complete search history.

(56) References Cited

U.S. PATENT DOCUMENTS

| | | | | | |
|---|---|---|---|---|---|
| 324,065 | A | | 8/1885 | Andrews | |
| 413,693 | A | | 10/1889 | Walker | |
| 3,941,377 | A | * | 3/1976 | Lie | A63B 22/0012 482/51 |
| 4,423,864 | A | * | 1/1984 | Wiik | A63B 22/0012 434/253 |
| 5,385,520 | A | * | 1/1995 | Lepine | A63B 22/0023 482/51 |
| 5,613,856 | A | * | 3/1997 | Hoover | A63B 69/18 434/253 |
| 5,878,378 | A | | 3/1999 | Schibly | |
| 6,065,762 | A | * | 5/2000 | Brelvi | A63C 17/0046 280/11.226 |
| 6,899,344 | B1 | * | 5/2005 | Raynor | A63C 17/02 280/11.221 |
| 2002/0084600 | A1 | * | 7/2002 | Bouldes, Jr. | A63C 17/04 280/11.19 |
| 2007/0287547 | A1 | * | 12/2007 | Gallagher | A63C 19/10 472/89 |

FOREIGN PATENT DOCUMENTS

| | | |
|---|---|---|
| DE | 10201101 | 8/2012 |
| EP | 2252378 A2 | 11/2010 |
| WO | WO2009112817 A2 | 9/2009 |

* cited by examiner

*Primary Examiner* — Kien Nguyen
(74) *Attorney, Agent, or Firm* — Integrity Patent Group, PLC; Edwin Wold

(57) ABSTRACT

A velocity sport boot system/velocity sport board for performing all-weather snowboarding activity. The velocity sport boot/board system includes a velocity sport boot assembly that provides a method of practicing snowboarding on a treadmill. The velocity sport boot assembly includes a boot liner, a boot body, and a plurality of ball bearing assemblies. The plurality of ball bearing assemblies further includes shock absorbing springs for user comfort on varying surfaces. An alternative embodiment of the velocity sport boot/board system uses a common snowboarding type boot affixed to a sport board assembly that includes a sport board base, coupling straps, and a plurality of ball bearing assemblies.

14 Claims, 5 Drawing Sheets

VELOCITY SPORT BOOT SYSTEMS

BACKGROUND OF THE INVENTION

The following includes information that may be useful in understanding the present invention. It is not an admission that any of the information provided herein is prior art, or material, to the presently described or claimed inventions, or that any publication or document that is specifically or implicitly referenced is prior art.

1. Field of the Invention

The present invention relates generally to the fields of footwear and boarding (for advanced users) for sporting/gaming purposes and more specifically relates to accessories for skiing or snowboarding, velocity sport boot and velocity sport board systems.

2. Description of Related Art

Snowboarding is a popular sport however it is seasonal in nature. Snowboarding offers the additional benefit of providing exercise in addition to fun and entertainment. Snowboarders desire to perform their sport on a year round basis. As a result, there exists the potential for developing an all-weather snowboarding system.

A snowboard boot is a boot made for the purpose of supporting a user's foot and ankle while allowing control of a snowboard. A snowboard boot/board can be modified in a manner that allows it to traverse a moving treadmill by creating a means with which the boot/board can roll along the treadmill's belt. Variations in the terrain can be simulated by altering the support surface beneath the treadmill's belt. In order to accommodate the varying surface, there exists a need for a snowboard boot or sport board that will allow the treadmill belt to pass beneath the user while absorbing variations in the treadmill's support surface. There exists a need for a solution to provide the ability to perform all-weather snowboarding.

Several attempts have been made to solve the above-mentioned problems such as those found in U.S. Pat. No. 5,878,378 to Schibly and Herbert, U.S. Pat. No. 4,136,93 to Walker, and U.S. Pat. No. 324,065 to Andrews and Foreign Pat Nos. WO/2009112817A2 and EP2252378A2 2010 to Dudgeon and DE102011011024A1 to Gleich. This art is representative of footwear for sporting purposes. However, none of the above inventions and patents, taken either singly or in combination, are seen to describe the invention as claimed.

Preferably, a velocity sport boot and velocity sport board system should provide a means by which to snowboard on a treadmill and, yet would operate reliably and be manufactured at a modest expense. Thus, a need exists for a reliable velocity sport boot system to avoid the above-mentioned problems.

BRIEF SUMMARY OF THE INVENTION

In view of the foregoing disadvantages inherent in the known accessories for skiing or snowboarding art, the present invention provides a novel velocity sport boot and velocity sport board system. The general purpose of the present invention, which will be described subsequently in greater detail is to provide a velocity sport boot/velocity sport board system suitable for use.

A velocity sport boot and velocity sport board system is disclosed herein, in a preferred embodiment, comprising a velocity sport boot assembly and velocity sport board assembly. Preferably the velocity sport boot assembly may comprise: a boot body; a boot liner; and a sole in functional combination. Preferably the velocity sport board assembly may comprise a board and a base in a functional combination.

In the preferred embodiment, the boot body further may comprise a boot fastening system, a sole, a vent, a foot cover, a tongue, an ankle support, and a flexible binding member. The boot body fastening system may further comprise lace hooks and laces for the purpose of securing the boot to the user's foot. Alternate embodiments of the velocity sport boot may comprise a boot fastening system that may comprise a series of lock strips and a series of lock levers that may be made of plastic. The sole of the boot or base of the board may comprise a plurality of ball bearing assemblies each comprising: ball bearings and a spring mounting assembly. The spring mounted assembly may further comprise a mounting fixture, and a shock absorbing spring. Relationally speaking, the ball bearings may be mounted within the ball bearing assemblies where they are movably retained in a manner that the shock absorbing springs allow for the bearings to absorb variations in the surface upon which they rest so as to reduce impact to the sole of the velocity sport boot assembly.

In the preferred embodiment the plurality of ball bearing assemblies are removable for cleaning the ball bearings; the spring mounting assembly is removable for cleaning the springs, and for replacing the springs. Alternate embodiments my use different strength shock absorbing springs in order to adjust the amount of impact experienced by the user.

In the preferred embodiment, the foot cover, the tongue, and the ankle support comprising the boot body may be made of a rigid material for supporting a user's ankle and a user's foot and may be made of an easy to clean material such as plastic. In alternate embodiments of the velocity sport boot system, the boot body may be available in a multitude of colors and a multitude of styles.

Relationally speaking the foot cover, the tongue, and the ankle support are bound together with a flexible binding member; wherein the flexible binding member material may comprise leather or a synthetic material such as vinyl or a combination thereof. In the preferred embodiment, the boot liner is removable from the velocity sport boot assembly in order to allow for cleaning and use of various sized boot liners based on the shoe size of the user. The boot liner may be made of a flexible material for providing comfort and for providing proper fit of the velocity sport boot.

An alternative embodiment of the velocity sport boot/board system uses a common snowboarding type boot affixed to a sport board assembly that includes a sport board base, coupling straps, and a plurality of ball bearing assemblies.

The velocity sport boot and velocity sport board system may further comprise a kit including the velocity sport boot and velocity sport board assembly; and a set of instructions.

A method of using a velocity sport boot and velocity sport board assembly system may comprise the steps of: obtaining the velocity sport boot/board system and wearing the velocity sport boot or velocity sport board system while on a moving treadmill. The method of use may further comprise the steps of ceasing operation of the treadmill and removing the velocity sport boot/board system.

The present invention holds significant improvements and serves as a velocity sports boot and velocity sport board system. For purposes of summarizing the invention, certain aspects, advantages, and novel features of the invention have been described herein. It is to be understood that not necessarily all such advantages may be achieved in accordance with any one particular embodiment of the invention.

Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a velocity sport boot and velocity sports board system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to footwear for sporting purposes and more specifically relates to accessories for skiing or snowboarding as used to improve the user's experience when snow is not available. Generally speaking, the velocity sport boot system applies to footwear for sporting purposes and more specifically relates to a system for practicing skiing or snowboarding.

Figure 1:
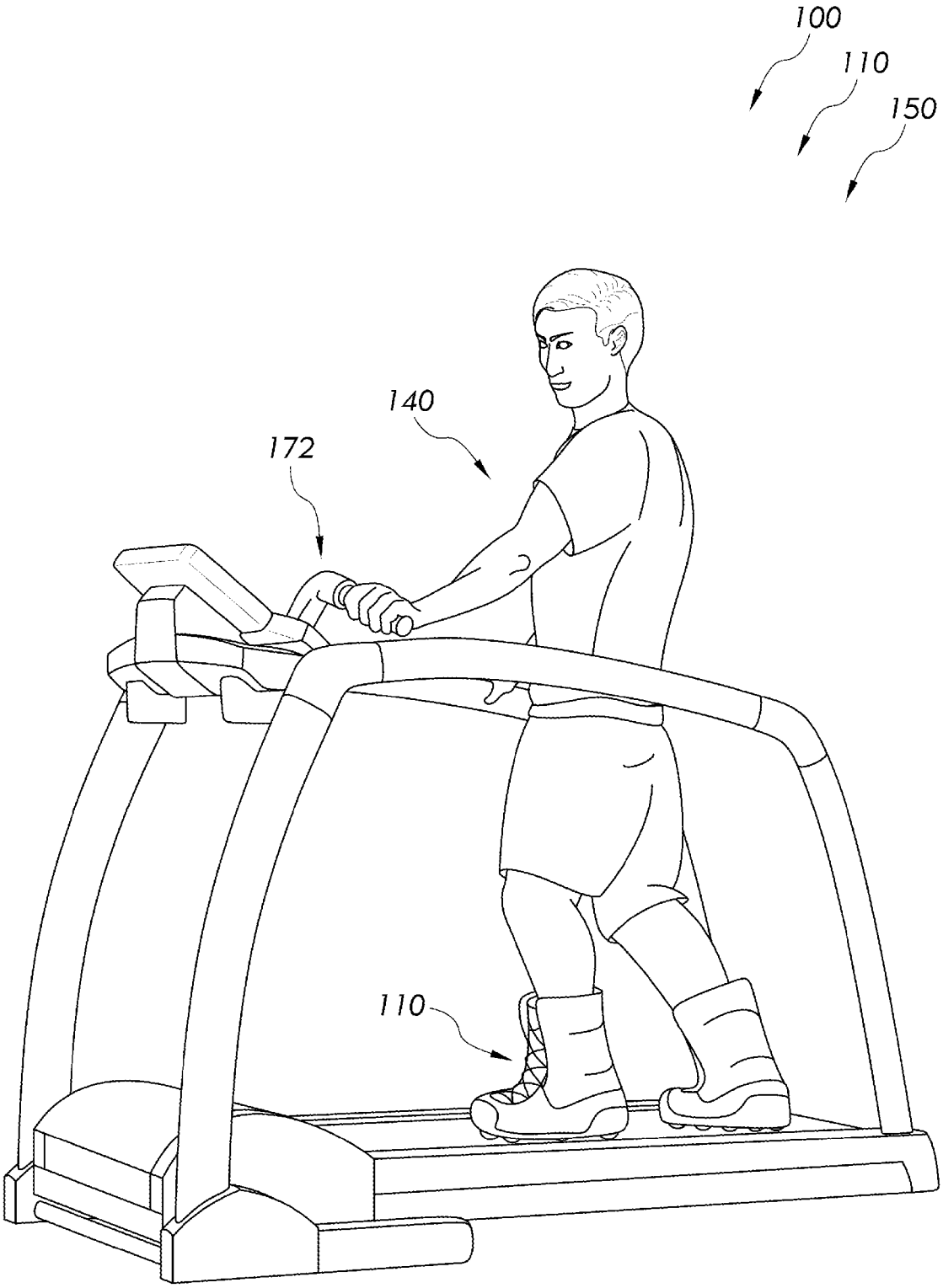
FIG. 1 shows a perspective view illustrating a velocity sport boot system during an 'in-use' condition showing a user wearing a velocity sport boot assembly while on a moving treadmill according to an embodiment of the present invention.

Referring to the drawings by numerals of reference there is shown in FIGS. 1-4, velocity sport boot system 100 during an 'in-use' condition 150 by user 140 in FIG. 1. FIG. 1 shows user 140 gripping treadmill control 172 to control speed, elevation, and surface variations of the treadmill.

Figure 2B:
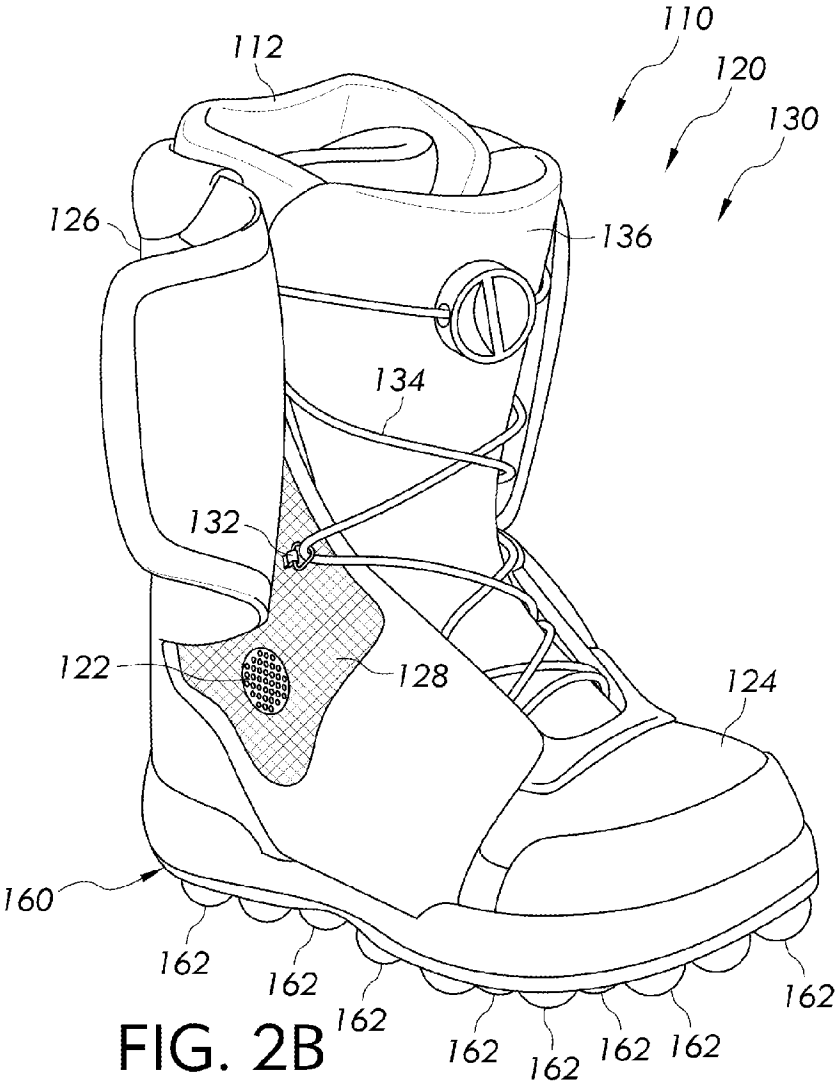
FIG. 2B is a perspective view illustrating the velocity sport boot assembly of the velocity sport board/boot system according to an embodiment of the present invention of FIG. 1.
Figure 2A:
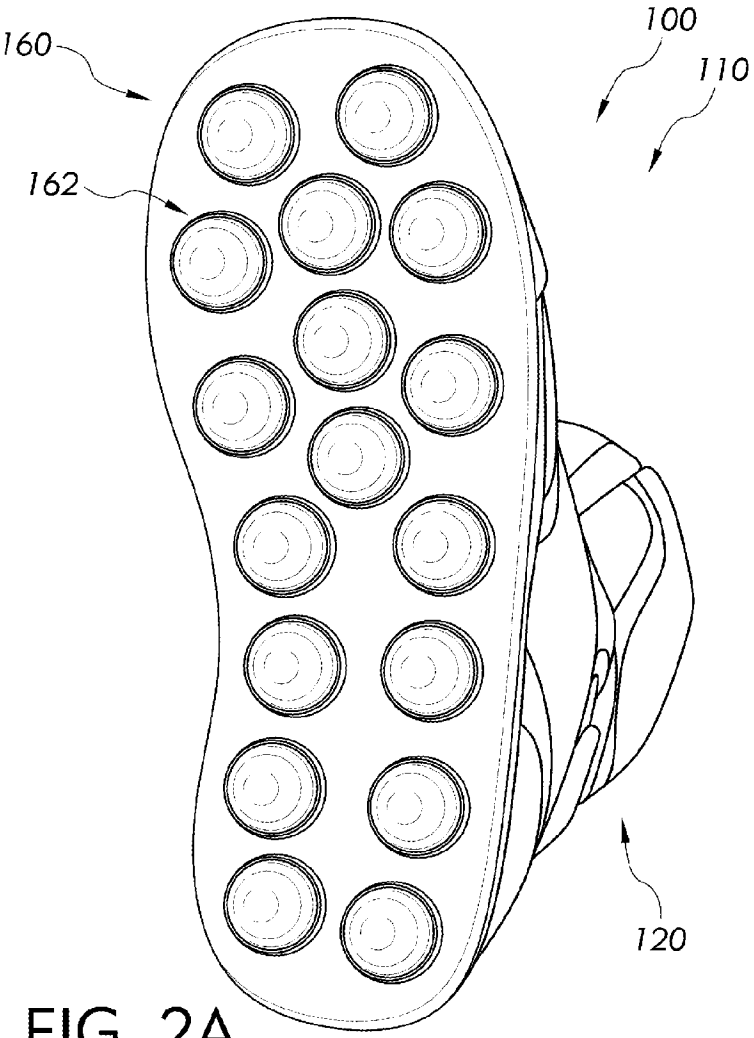
FIG. 2A is a perspective view illustrating the velocity sport boot assembly of the velocity sport boot system according to an embodiment of the present invention of FIG. 1.

Referring now to FIGS. 2A and 2B, an illustration of a Velocity sport boot assembly 110 is shown comprising boot body 120, boot liner 112, sole 160, vent 122, foot cover 124, tongue 136, ankle support 126, and flexible binding member 128. Flexible binding member 128 is used to connect boot body 120 components vent 122, foot cover 124, tongue 136, and ankle support 126 in a manner that allows ankle and foot support while enabling movement and flexibility of the velocity sport boot assembly 110 in relation to a moving treadmill belt. Flexible binding member 128 can be made of a flexible material such as leather or vinyl or a synthetic material. Foot cover 124, tongue 136, ankle support 126 may be made of a rigid material for supporting a user's 140 ankle and a user's 140 foot. Vent 122, foot cover 124, tongue 136, ankle support 126 may made of an easy to clean material such as plastic or other such suitably equivalent material. In alternate embodiments of the velocity sport boot assembly 110, the boot body 120 may be available in a multitude of colors and a multitude of styles. FIG. 3 also shows boot fastening system 130 comprising lace hooks 132, and laces 134 for the purpose of securing the boot to the user's 140 foot. Alternate embodiments of boot fastening system 130 may comprise a series of lock strips and a series of lock levers or the like.

Boot liner 112 is removable for cleaning and is made of a flexible material for providing comfort and proper fit. Boot line 112 is sizable to varying foot size thus offering additional versatility to the design.

Figure 3A:
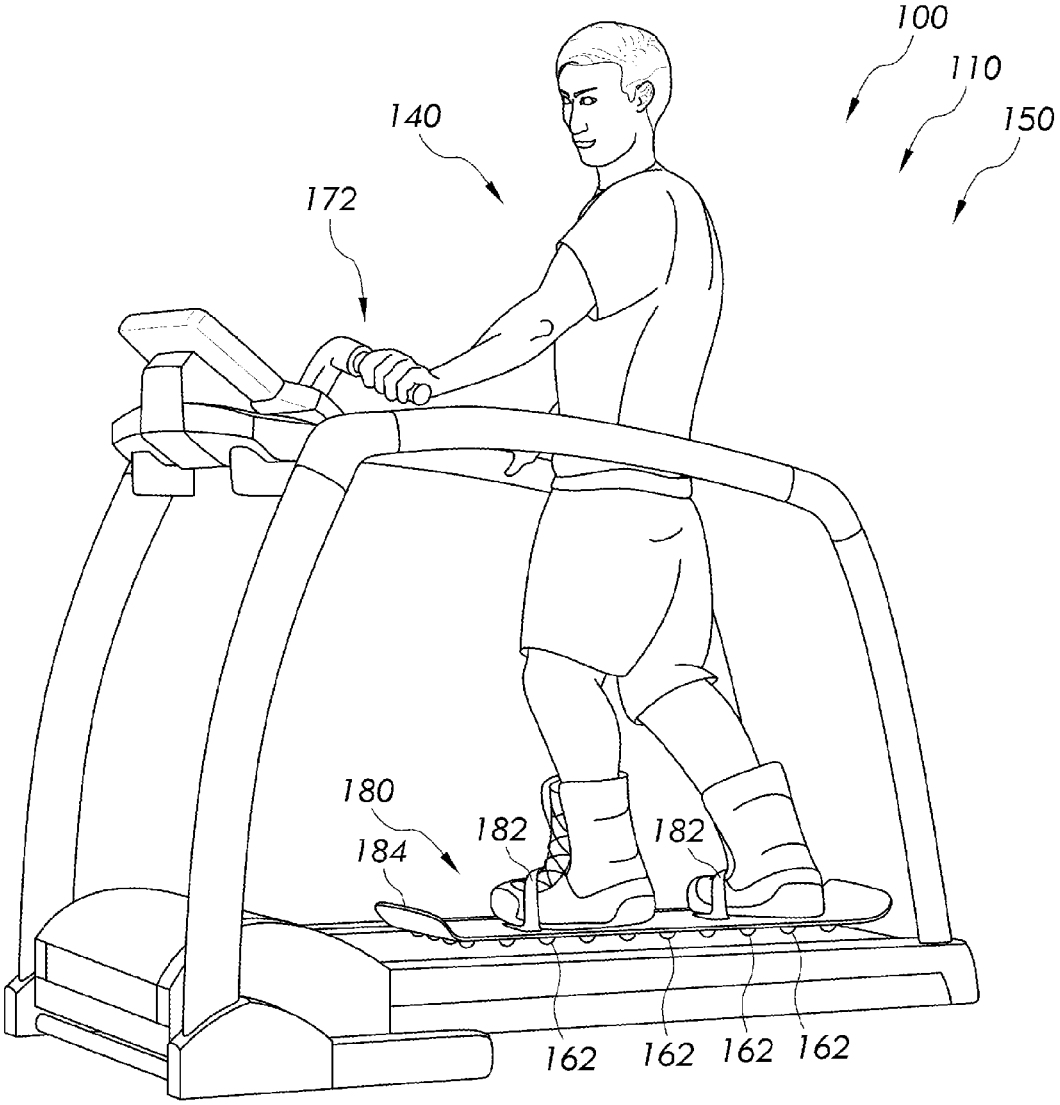
FIG. 3A is a perspective view illustrating the velocity sport board system assembly in an "in-use" condition.
Figure 3B:
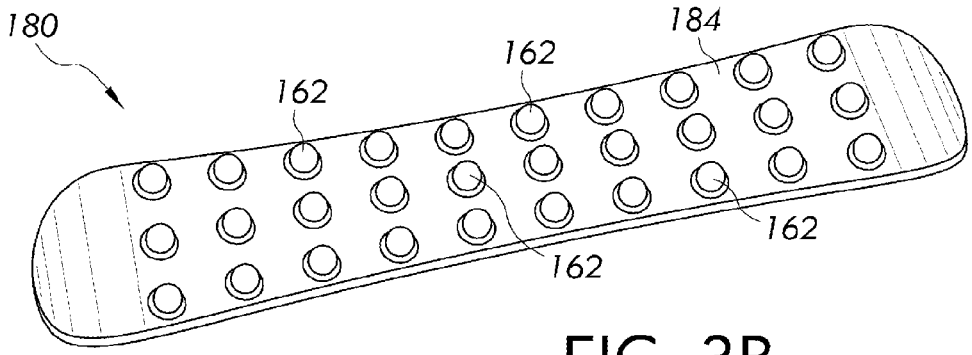
FIG. 3B is a perspective view illustrating the velocity sport board assembly according to an embodiment of the present invention of FIGS. 1A-3A.

Referring now to FIGS. 3A and 3B showing the sport board assembly 180 of the velocity sport board assembly 180 during an "in-use" condition 150 where the user 140 is wearing common snowboarding boots that are affixed to sport board assembly 180 with coupling straps 182. FIG. 3A shows how the sport board assembly 180 has coupling straps 182. FIG. 3B shows how the sport board assembly 180 has a plurality of ball bearing assemblies 162 affixed to sport board base 184 in functional combination to allow the treadmill to pass beneath user 140.

Figure 4:
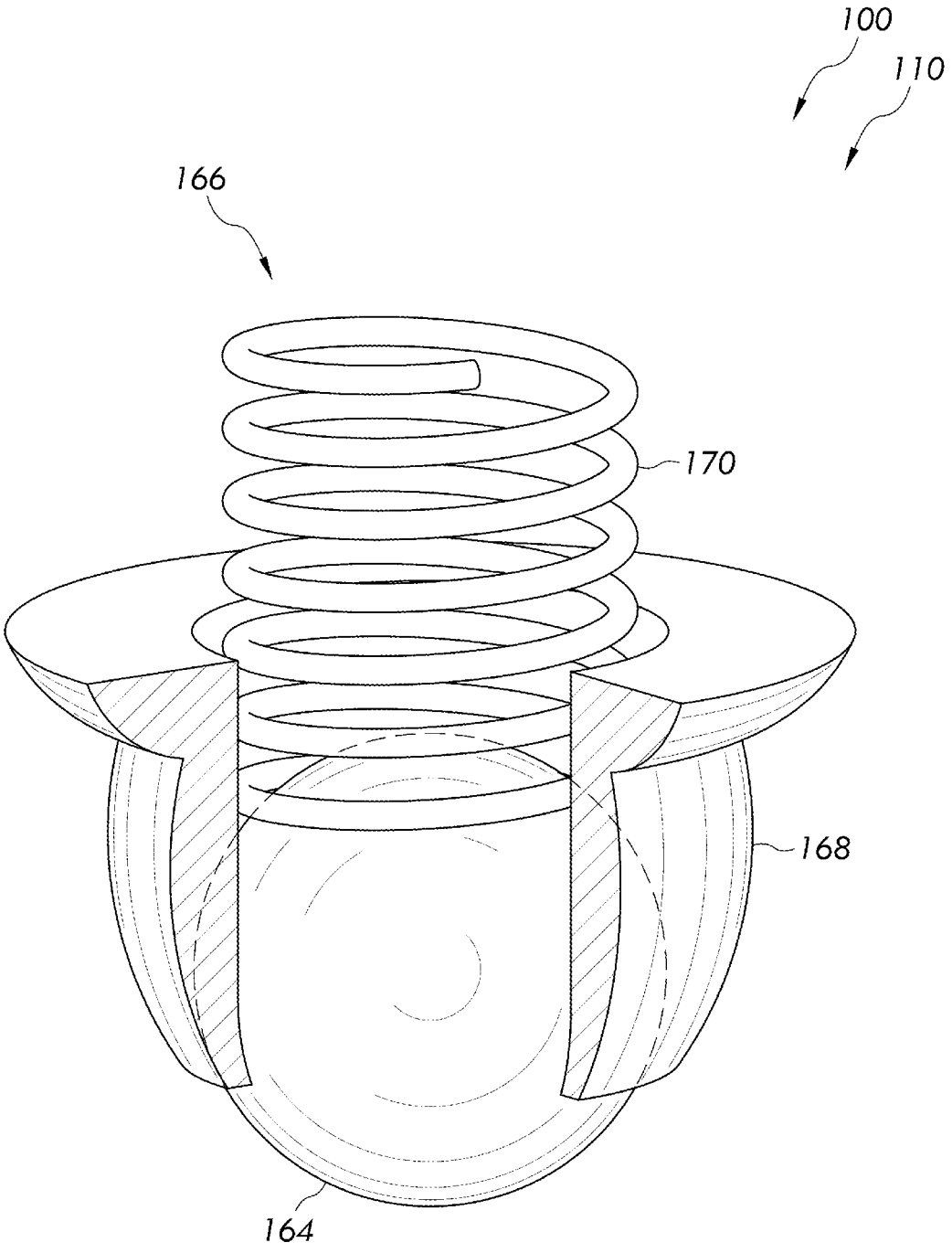
FIG. 4 is a perspective view illustrating an example of the plurality of ball bearing assemblies of the velocity sport boot/board assembly according to an embodiment of the present invention of FIGS. 1-3.

Referring now to FIG. 4, sole 160 preferably comprises a plurality of ball bearing assemblies 162 each comprising ball bearings 164 and a spring mounting assembly 166. Spring mounting assembly 166 further comprises a mounting fixture 168 and a shock absorbing spring 170. Relationally speaking sole 160 serves as a mounting platform for the plurality of ball bearing assemblies 162. Shock absorbing spring 170 is supported by the sole allowing ball bearing 164 to move within mounting fixture 168 for the purpose of absorbing variations in the treadmill's surface. Mounting fixture 168 retains ball bearing 164. Shock absorbing spring 170 can be removed for cleaning and changing to varying spring types that allow versatility in the amount of spring resistance. Mounting fixture 168 is removably couplable from sole 160 for easy cleaning of ball bearing 164 and shock absorbing spring 170.

Velocity sport boot system 100 may be sold as kit 440 comprising the following parts: at least one velocity sport boot assembly and at least one set of user instructions. The kit has instructions such that functional relationships are detailed in relation to the structure of the invention (such that the invention can be used, maintained, or the like in a preferred manner). Velocity sport boot system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different fastening and maneuvering means and combinations, parts may be sold separately, etc., may be sufficient.

Figure 5:
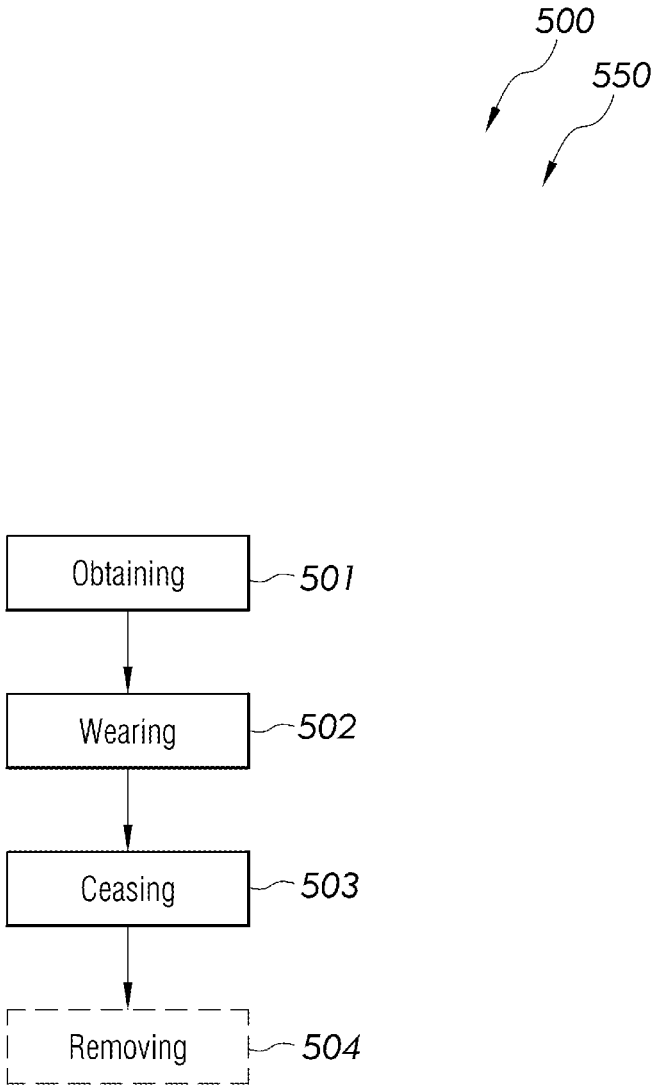
FIG. 5 is a flowchart illustrating a method of use for velocity sport boot/velocity sport board system according to an embodiment of the present invention of FIGS. 1-4.

Referring now to FIG. 5 showing flowchart 550 illustrating method of use 500 for velocity sport boot system 100 according to an embodiment of the present invention of FIGS. 1-4. As shown, method of use 500 may comprise the steps of: step one 501, obtaining the velocity sport boot system 100; step two 502 wearing the velocity sport boot assembly 110 while on a moving treadmill; step three 503 ceasing operation of the treadmill; and step four 504 removing the velocity sport boot assembly 110.

It should be noted that step 504 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A velocity sport boot system and a velocity sport board comprising:
- a velocity sport boot assembly comprising
  - a boot fastening system comprising;
    - lace hooks; and
    - laces;
  - a vent;
  - a foot cover;
  - a tongue;
  - an ankle support; and
  - a flexible binding member;
- a boot liner;
- a sole comprising:
  - a first plurality of ball bearing assemblies each comprising;
    - ball bearings;
- a spring mounting assembly comprising;
  - a mounting fixture; and
  - a shock absorbing spring;
- a treadmill control; and
- a sport board assembly comprising:
  - a sport board;
  - a coupling strap; and
  - a second plurality of ball bearing assemblies;
- wherein said first and second plurality of ball bearing assemblies comprises: said ball bearings; said spring mounting assembly comprising said mounting fixture; and said shock absorbing spring;
- wherein said treadmill control is mountable and electrically connectable to a treadmill to control speed, elevation, and surface variations of the treadmill wherein said velocity sport boot and sport board assemblies are configured to be worn by a user and moved on said treadmill.

2. The velocity sport boot system of claim 1 wherein said foot cover, said tongue, and said ankle support comprising said boot body are made of a rigid material for supporting a user's ankle and a user's foot.

3. The velocity sport boot system of claim 1 wherein said foot cover, said tongue, and said ankle support comprising said boot body are made of an easy to clean material.

4. The velocity sport boot system of claim 1 wherein said foot cover, said tongue, and said ankle support are bound together with said flexible binding member to allow movement.

5. The velocity sport boot system of claim 4 wherein said flexible binding member is leather.

6. The velocity sport boot system of claim 5 wherein said flexible binding member is a synthetic material.

7. The velocity sport boot system of claim 1 wherein said boot liner is removable.

8. The velocity sport boot system of claim 7 wherein said boot liner is made of a flexible material.

9. The velocity sport boot assembly of claim 1 wherein said boot fastening system comprises a series of lock strips and a series of lock levers.

10. The velocity sport boot system of claim 9 wherein said ft series of lock strips and said series of lock levers comprising said boot fastening system are made of plastic.

11. The velocity sport boot system of claim 1 wherein said plurality of ball bearing assemblies is removable.

12. The velocity sport boot system of claim 1 wherein said spring mounting assembly is removably couplable for replacing.

13. A velocity sport boot system of comprising:
- a velocity sport boot assembly comprising
  - a boot fastening system comprising;
    - lace hooks; and
    - laces;
  - a vent;
  - a foot cover;
  - a tongue;
  - an ankle support; and
  - a flexible binding member;
- a boot liner;
- a sole comprising:
  - a plurality of ball bearing assemblies each comprising;
    - ball bearings;
    - a spring mounting assembly comprising;
      - a mounting fixture; and
      - a shock absorbing spring;
- a treadmill control; and
- a sport board assembly comprising:
  - a sport board;
  - a coupling strap; and
  - a plurality of ball bearing assemblies;
- wherein said foot cover; said tongue; and said ankle support comprising said boot body are made of a rigid material;

wherein said foot cover; said tongue; and said ankle support comprising said boot body are made of an easy to clean material;

wherein said foot cover; said tongue; and said ankle support comprising said boot body are bound together with said flexible binding member;

wherein said flexible binding member material is made of a synthetic material;

wherein said boot liner is removable;

wherein said plurality of ball bearing assemblies are removable;

wherein said spring mounting assembly is removable;

wherein said treadmill control is mountable and electrically connectable to a treadmill to control speed, elevation, and surface variations of the treadmill wherein said velocity sport boot and sport board assemblies are configured to be worn by a user and moved on said treadmill.

14. The velocity sport boot system of claim 13 further comprising a kit including: said velocity sport boot assembly and a set of instructions.

* * * * *